US008534719B2

(12) United States Patent
Chow

(10) Patent No.: US 8,534,719 B2
(45) Date of Patent: Sep. 17, 2013

(54) DOOR TOP LATCHING ACTUATION

(75) Inventor: William Chung-Sum Chow, Rowland Heights, CA (US)

(73) Assignee: Adams Rite Manufacturing Co., Pomona, CA (US)

( * ) Notice: Subject to any disclaimer, the term of this patent is extended or adjusted under 35 U.S.C. 154(b) by 131 days.

(21) Appl. No.: 13/199,760

(22) Filed: Sep. 9, 2011

(65) Prior Publication Data

US 2013/0062892 A1 Mar. 14, 2013

(51) Int. Cl.
*E05C 1/06* (2006.01)
*E05C 19/00* (2006.01)
*E05B 3/00* (2006.01)

(52) U.S. Cl.
USPC ..... 292/175; 292/1; 292/336.3

(58) Field of Classification Search
CPC ... E05B 63/06; E05B 65/006; E05B 63/0056; E05C 1/06
USPC ..... 292/137, 163, 164, 336.3, 171, 347, 292/DIG. 21, DIG. 44, DIG. 51, 1.5, 169, 292/173, 143, 175
See application file for complete search history.

(56) References Cited

U.S. PATENT DOCUMENTS

| | | | | | |
|---|---|---|---|---|---|
| 595,505 | A | * | 12/1897 | Wesley | 292/167 |
| 724,521 | A | * | 4/1903 | Teeter | 292/169.21 |
| 1,203,116 | A | | 10/1916 | Hurd | |
| 1,516,628 | A | * | 11/1924 | Blackwell | 292/39 |
| 1,544,960 | A | | 7/1925 | Watts | |
| 1,638,748 | A | | 8/1927 | Santee | |
| 1,775,786 | A | * | 9/1930 | Steventon et al. | 292/169.21 |
| 2,169,692 | A | * | 8/1939 | Hansen | 292/5 |
| 2,458,751 | A | | 1/1949 | Voight | |
| 2,889,164 | A | | 6/1959 | Clark | |
| 3,083,560 | A | * | 4/1963 | Scott | 70/92 |
| 3,281,176 | A | | 10/1966 | McKey | |
| 4,083,590 | A | | 4/1978 | Folger | |
| 4,130,306 | A | | 12/1978 | Brkic | |
| 4,145,900 | A | | 3/1979 | Ohno | |
| 4,183,565 | A | | 1/1980 | Allemann | |
| 4,263,795 | A | * | 4/1981 | Van Gompel | 70/99 |
| 4,311,329 | A | | 1/1982 | Kral | |
| 4,368,905 | A | | 1/1983 | Hirschbein | |
| 4,458,928 | A | | 7/1984 | Hirschbein | |
| 4,598,939 | A | | 7/1986 | Krupicka et al. | |
| 4,714,285 | A | | 12/1987 | Langham | |
| 4,726,613 | A | | 2/1988 | Foshee | |
| 4,824,150 | A | | 4/1989 | Smith et al. | |
| 4,838,587 | A | | 6/1989 | Choi | |
| 4,906,034 | A | | 3/1990 | Verlycken | |
| 5,464,259 | A | | 11/1995 | Cohrs et al. | |
| 5,570,913 | A | * | 11/1996 | Puric | 292/36 |
| 5,782,509 | A | | 7/1998 | Uyeda | |
| 5,851,059 | A | | 12/1998 | Cirocco | |

(Continued)

*Primary Examiner* — Kristina R Fulton
*Assistant Examiner* — Nathan Cumar
(74) *Attorney, Agent, or Firm* — Woods Oviatt Gilman LLP

(57) ABSTRACT

Door top latch and actuating apparatus, comprising in combination, a mounting bracket configured to attach to a door top, a latch located by the bracket to move up and down, relative to the door top, an actuator rod extending vertically below the latch, and operatively connected to the latch whereby door handle operated vertical movement of the rod moves the latch vertically, and a compression spring associated with the rod for urging the rod and latch upwardly into latching position, the spring accommodating downward movement of the rod and latch, to unlatch the door, and a motion adaptor operatively connected between the rod and latch.

17 Claims, 8 Drawing Sheets

(56) References Cited

U.S. PATENT DOCUMENTS

| | | | | |
|---|---|---|---|---|
| 5,951,132 | A | 9/1999 | Cirocco | |
| 6,120,071 | A | 9/2000 | Picard et al. | |
| 6,174,004 | B1 | 1/2001 | Picard et al. | |
| 6,224,178 | B1 | 5/2001 | Cirocco | |
| 6,282,929 | B1 | 9/2001 | Eller et al. | |
| 7,055,351 | B2 | 6/2006 | Suzuki et al. | |
| 7,410,195 | B1 * | 8/2008 | Martin et al. | 292/332 |
| 8,313,127 | B2 * | 11/2012 | Helms | 292/259 A |

* cited by examiner 11
17
14
13
29
35
10
70
26
68
60
30
~12~

15
17
19
17d
14
13
11a
16
14a
18
16
10b
29
21
13a
14b
21a
39
38
6
11
7
7
12
37
35a
21b
35
75
10a
36
10
26a
35c
35b
6
26
70
71

DOOR TOP LATCHING ACTUATION

BACKGROUND OF THE INVENTION

This invention relates generally to controlling the locking of doors, and more particularly the unlocking of doors as at their tops.

There is need for compact, simple, durable efficient and secure door unlocking systems, and methods, particularly when unlocking is needed at opposite sides of doors. This is of particular need when unlocking is required as in response to turning of door handles and no door latching mechanism is to be employed or is available, at vertical edges of doors, for security reasons.

SUMMARY OF THE INVENTION

It is a major object of the invention to provide door unlocking apparatus and methods of operation, to meet the above need. Basically, the apparatus of the invention comprises door top latching apparatus, comprising in combination:

a) a mounting bracket configured to attach to a door top, b) a latch located by the bracket to move up and down, relative to the door top, c) an actuator rod extending vertically below the latch, and operatively connected to the latch whereby door handle operated vertical movement of the rod moves the latch vertically, d) and a compression spring associated with the rod for urging the rod and latch upwardly into latching position, the spring accommodating downward movement of the rod and latch, to unlatch the door, e) and a motion adaptor operatively connected between the rod and latch.

As will be seen, a door handle rotation responsive assembly is typically connected to the lower end of the rod, and characterized in that rotation of the assembly effects downward compression of the spring, the door carrying the latching assembly, spring and latch in compact integration. The door top typically has a cut-out or recess in alignment with the actuating rod, latch and spring for highly efficient handle rotation responsive operation.

Another object includes provision of a secondary compression spring associated with the bracket, and supporting the rod.

A further object includes provision of an adaptor operatively connecting the upper end of the rod to the latch, in concealed position, as in the cut-out in the door top. In this regard, a support for the secondary spring may also be located in the cut-out, in concealed condition, at the door top.

Another object comprises provision of an adjustable connection at the lower end of the rod, blocking rod rotation and thereby rotationally adjusts the position of the adaptor relative to the latch above the adaptor, the adaptor having threaded connection to the rod.

These and other objects and advantages of the invention, as well as the details of an illustrative embodiment, will be more fully understood from the following specification and drawings, in which:

DRAWING DESCRIPTION

DETAILED DESCRIPTION

Figure 5:
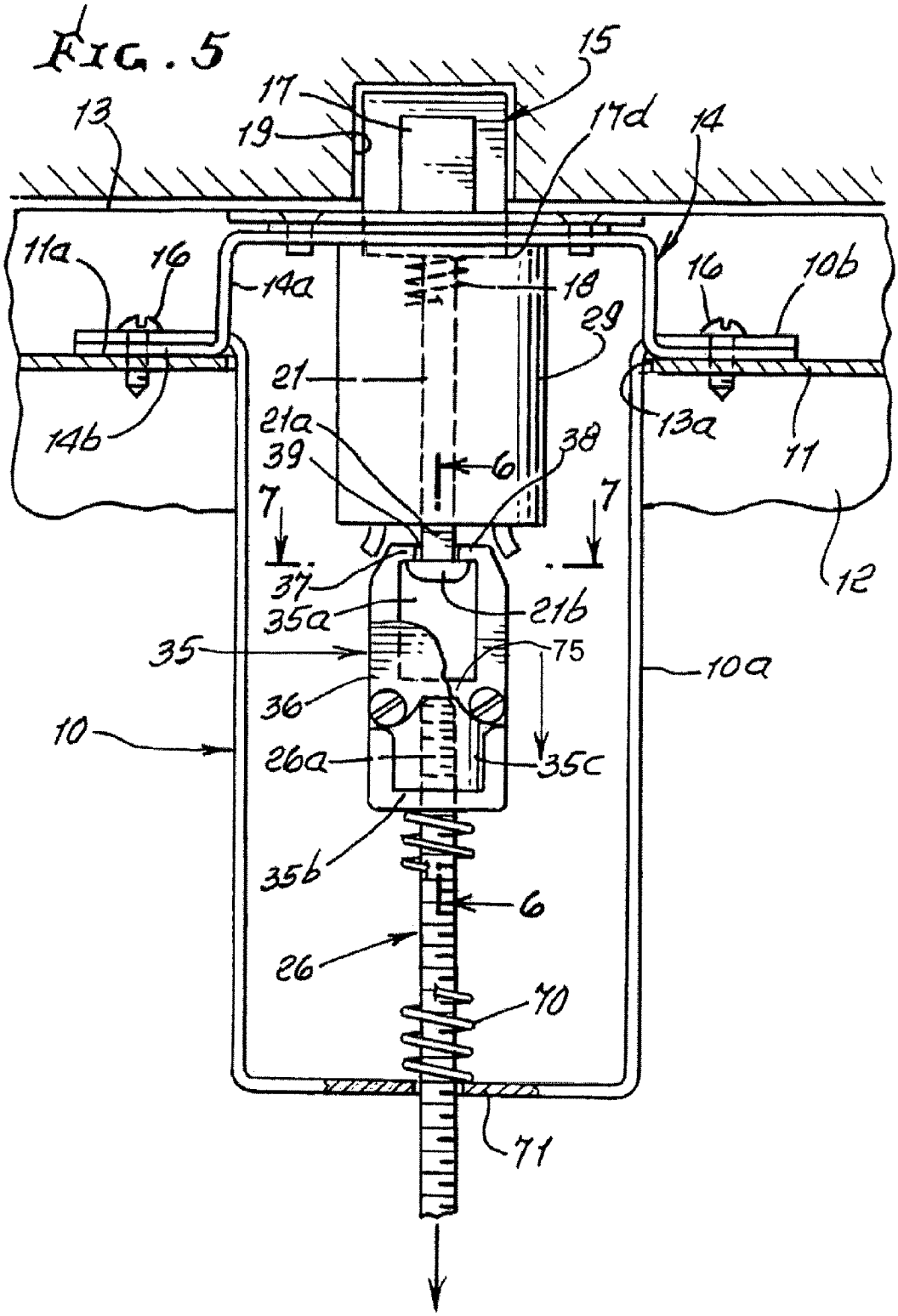
FIG. 5 is a detailed and enlarged view of upper extent of the assembly.

In the drawings, showing a preferred top latch actuating device, a U-shaped mounting bracket 10 is attached to the top ledge 11 of a door 12, recessed below the door top edge 13. Cut-out 13*a* allows reception of the bracket U-shaped portion 10*a* below the level of ledge 11. Ledge 11 also carries a mounting bracket 14 for a top latch 15. Bracket 14 has a U-shaped portion 14*a* extending upwardly toward the level of edge 13. The bracket 10 has mounting wings 10*b* extending horizontally over ledge extents 11*a*; and bracket 14 also has mounting wings 14*b* extending horizontally over door ledge extents 11*a*. Fasteners 16 connect the wings 10*b* and 14*b* to such ledge extents, at opposite sides of the cut-out, whereby retractable latch 17 is centered relative to the brackets, for up-down movement. FIG. 5 shows the latch 17 urged upwardly by a spring 18 into a recess in 19 in wall structure, above the door 12, as for locking the door.

The latch structure includes a cylindrical body 29 carried by and assembled to bracket 14, and projecting downwardly within the interior of the protective bracket 10. A plunger 21 projects downwardly within body 29, and protrudes at 21*a* below the bottom level of 29 to terminate at an enlarged head 21*b*. Compression spring 18 extends about 21, within 29, and urges the latch 17 lower structure 17*d* upwardly, into the position as seen in FIG. 5. The plunger upper end is attached to 17*d*, to move with the latch, and to displace the latch downwardly upon pulling of the plunger downwardly, acting to compress the spring 18. Such downward displacement of the latch 17 releases it from the wall recess 19.

Such downward displacement of the latch is effected by downward pulling of an elongated actuator rod 26, which may not be in direct axial alignment with plunger 21, for operating the latch, due for example to sideward deviation at its lower end connection to mechanism operated by door handle 30. Also, rod weight transmission to the plunger may exert unwanted side loading tending to bind or interfere with smooth operation of the latch. This is further affected by upward force transmission by compression spring 18 exerted at the lower end of the latch. As shown, spring 18 typically extends about the plunger, to resist downward travel of the plunger, as handle 30 is rotated.

Figure 6:
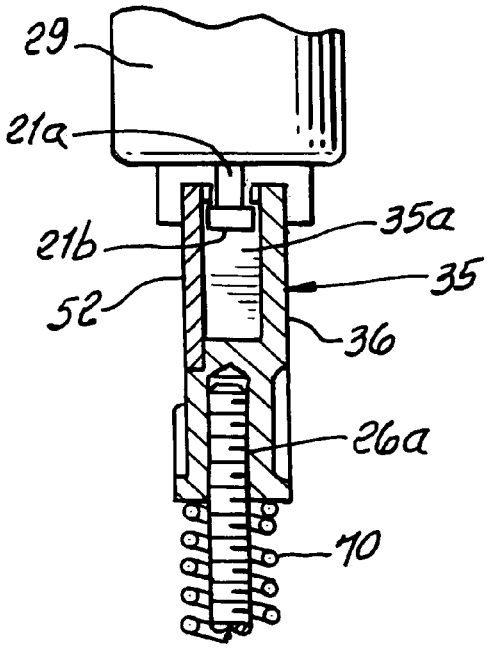
FIG. 6 is a side elevation taken on lines 6-6 of FIG. 5.
Figure 7:
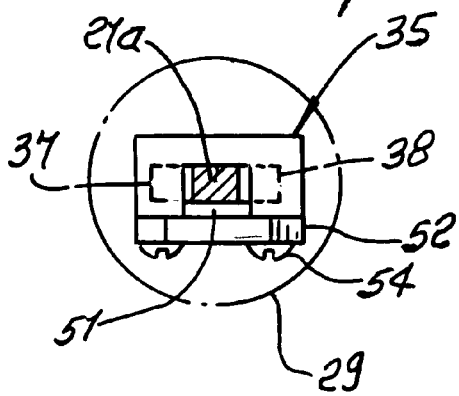
FIG. 7 is a horizontal section taken on lines 7-7 of FIG. 5.

To overcome such difficulties, a motion adaptor is provided to be easily assembled to and between the upper end 26*a* of the rod 26 and the latch mechanism, as at the time of installation. As shown in FIGS. 5-7, the adaptor 35 is readily connected to the latch mechanism as by sideward connection to the lower end of the plunger 21, as shown in FIG. 5. The illustrated adaptor 35 comprises a hollow body 36 upwardly threadably receiving the threaded upper end 26*a* of the rod, and downwardly receiving the plunger 21, with the plunger head 21*b* rotatably and loosely received within the adaptor upper chamber 35*a*. Note the adaptor sideward projections 37 and 38 abutting the upper surface of head 21*b*. A slight radial gap is provided at 39 between the outer cylindrical surface 21*a* of the plunger, and the projections 37 and 38, allowing limited lateral relative adjustment of the rod between the adaptor and the plunger. The upper end portion 26*a* of the rod is threaded for screw-on connection to the adaptor bottom wall 35*b* during assembly, the rod end projecting in chamber 35*c* toward the adaptor interior wall 35*a*. The adaptor can be rotated on the rod threading to lengthwise adjusted position.

Figure 8:
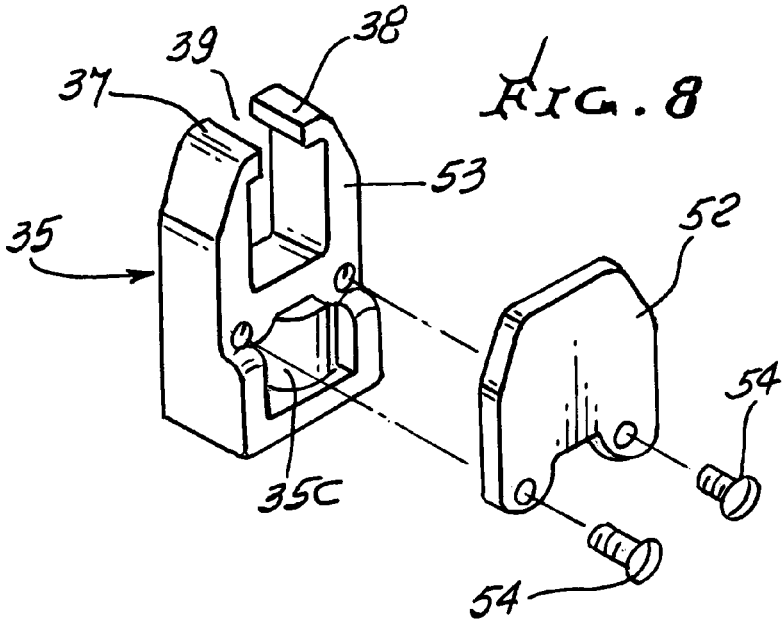
FIG. 8 is a perspective view of components of a captivating adaptor, as seen in side view in FIG. 5.
Figure 9:
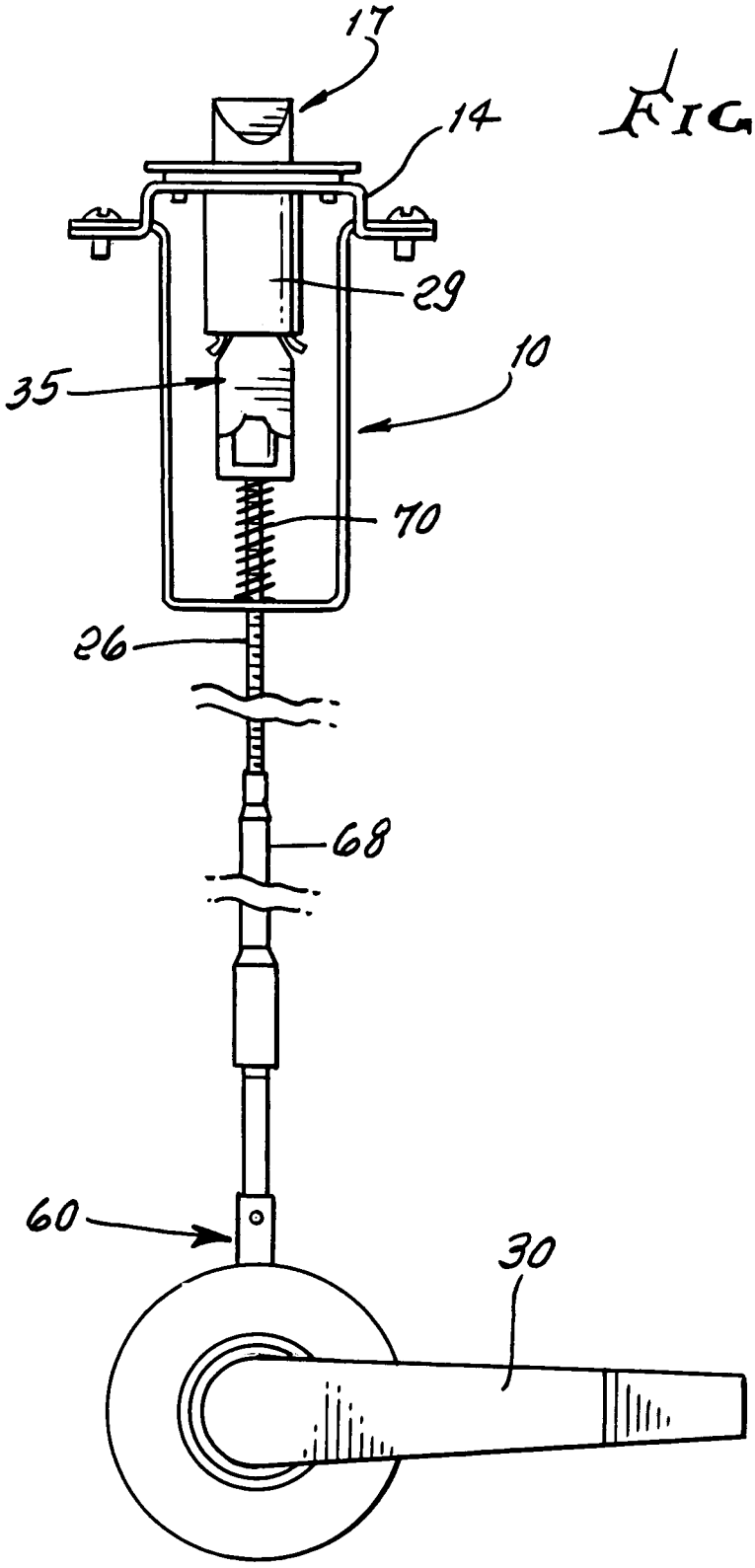
FIG. 9 is a view like FIG. 2, but with the door removed.
Figure 10:
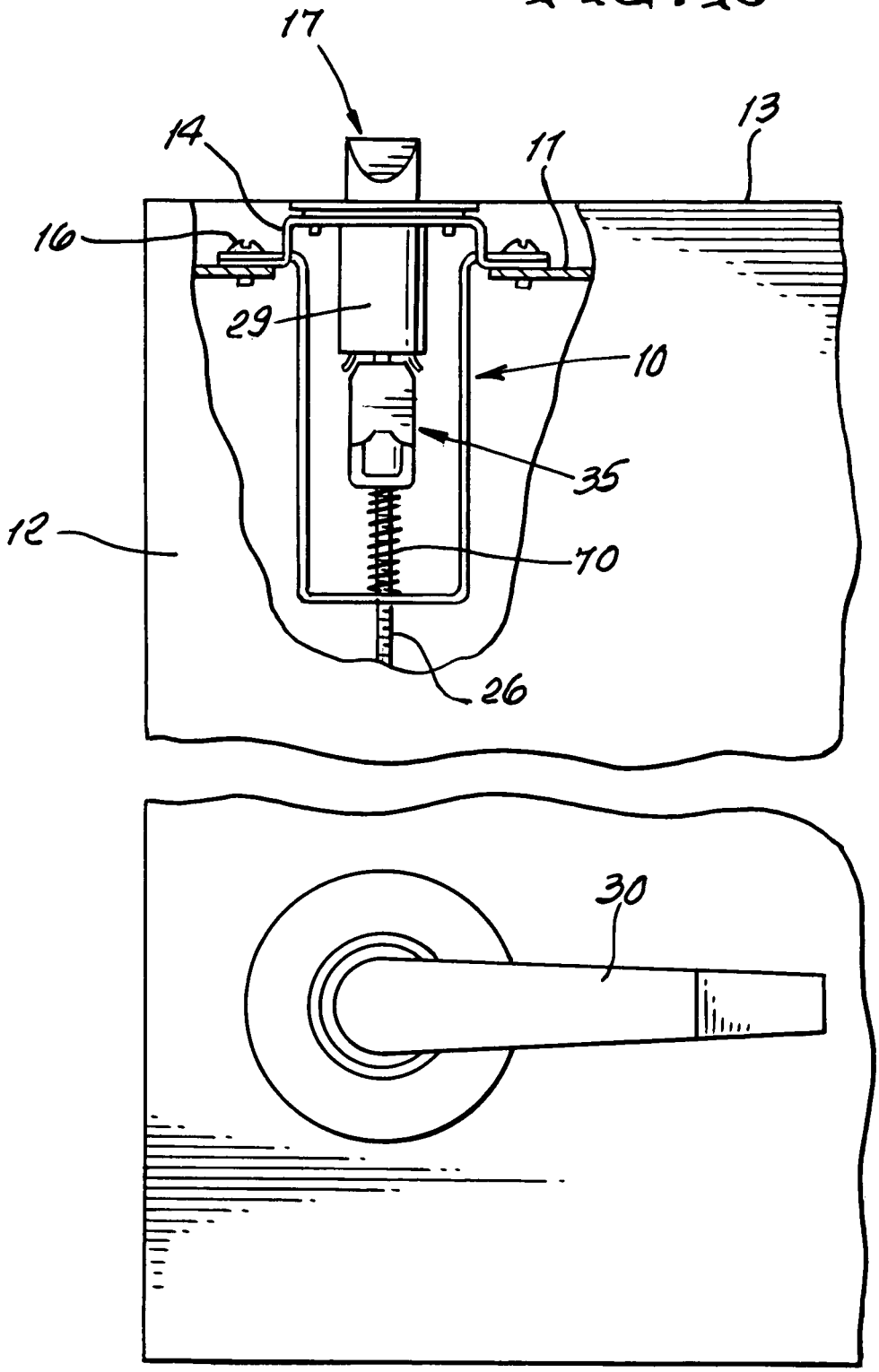
FIG. 10 is a view like FIG. 9 but with door components in place.
Figure 11:
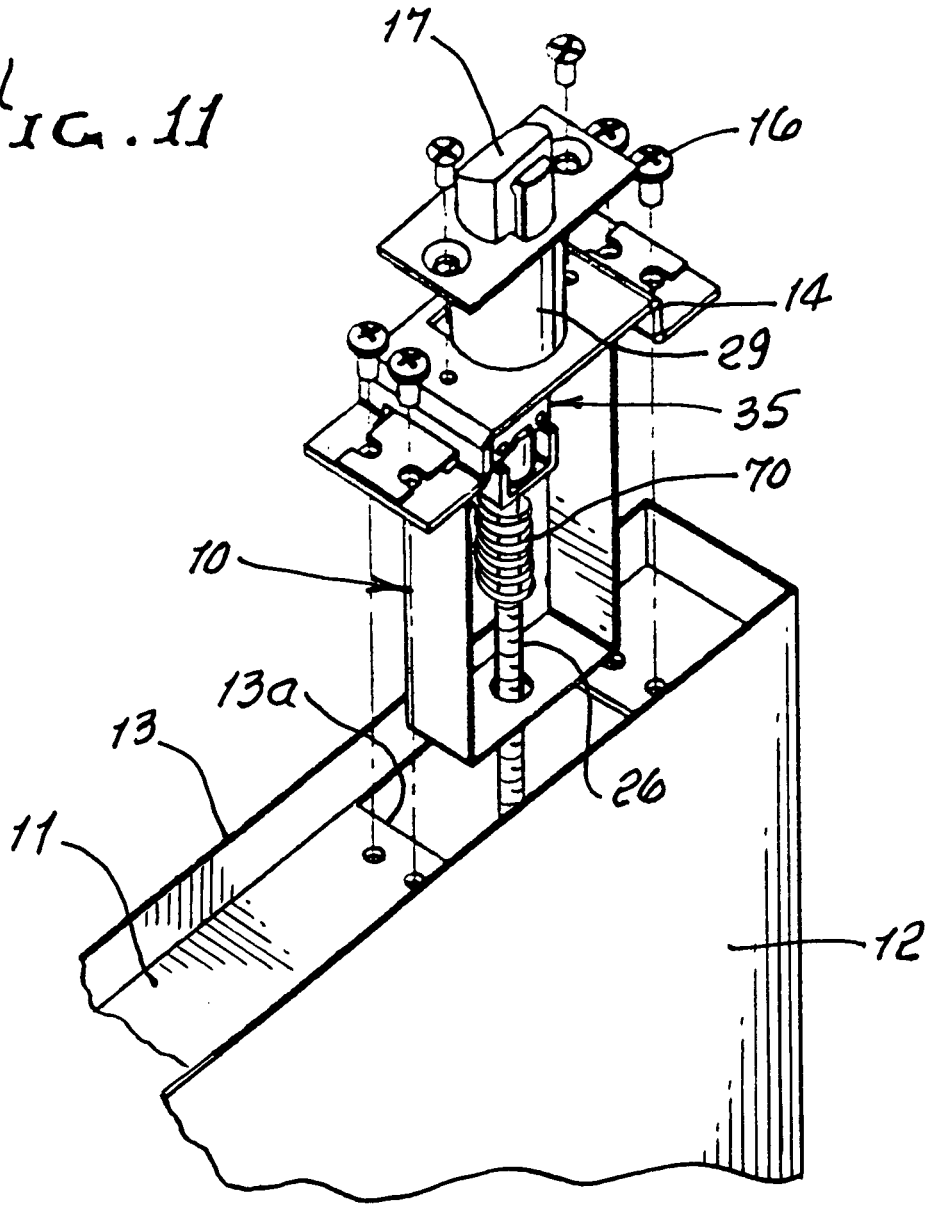
FIG. 11 is a perspective, exploded view of door top components.

Thereafter, the plunger is fitted through adaptor open side 51, see in FIGS. 7 and 8, and a cover 52 attached to the adaptor side 53 and fastened as via fasteners 54, captivating the plunger head in position in the adaptor, as seen in FIGS. 5 and 6. Accordingly, the assembly of components enables self-adjustment of the elongated rod to the latch, preventing binding during use.

Figure 1:
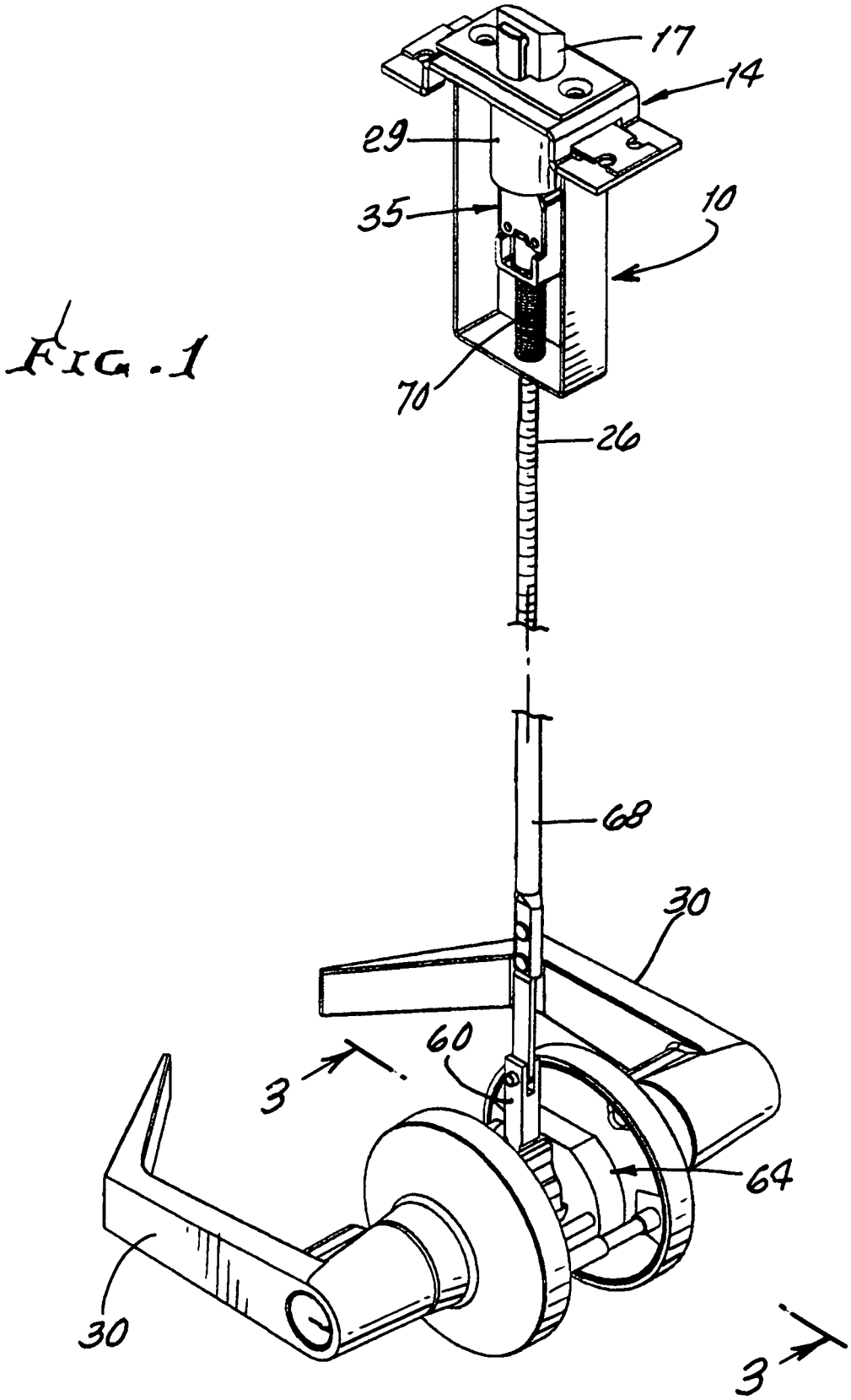
FIG. 1 is a perspective view of the latch actuation assembly.
Figure 2:
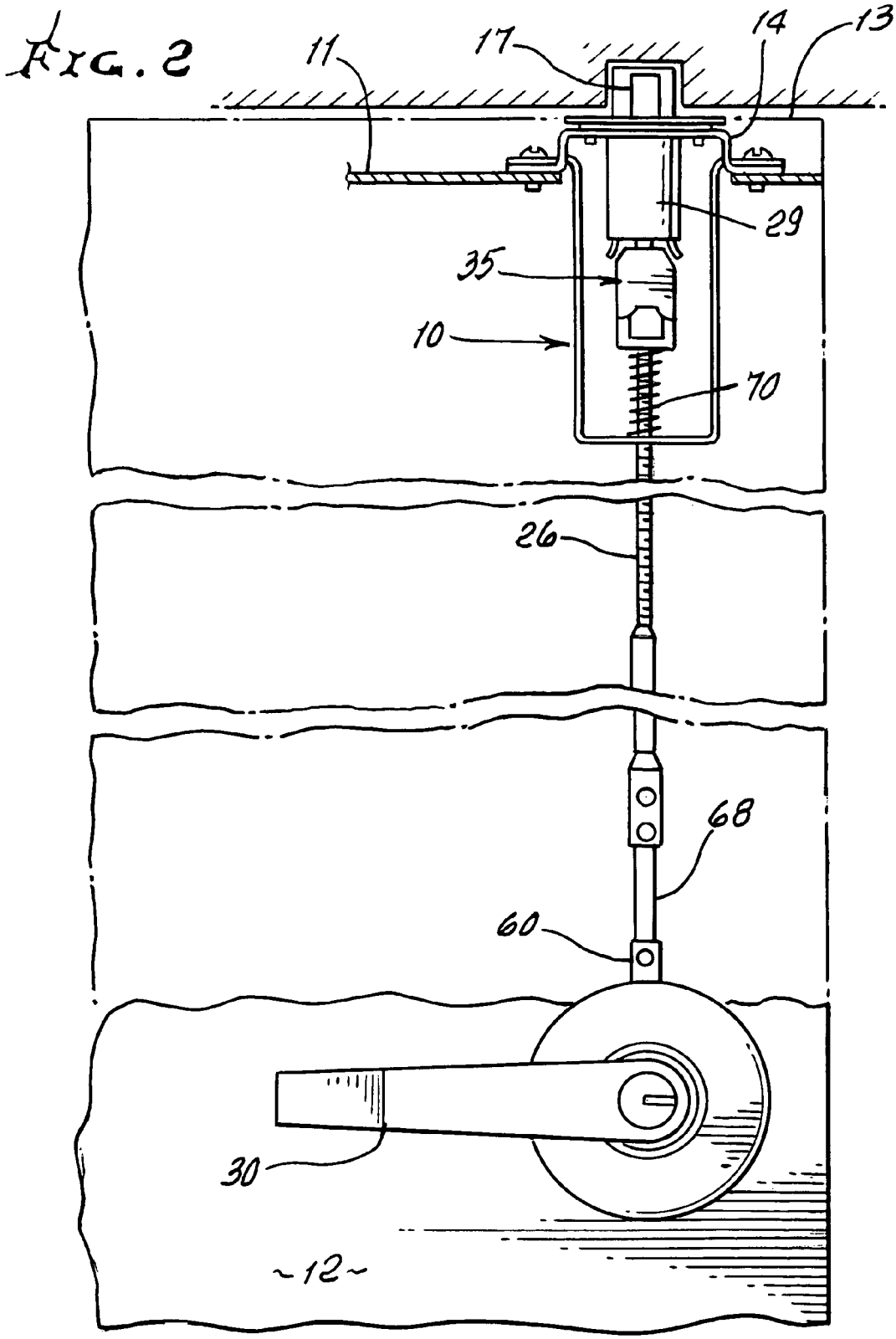
FIG. 2 is an enlarged side view of the FIG. 1 assembly.
Figure 4:
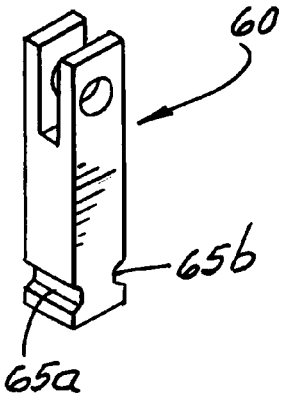
FIG. 4 is a perspective view of a spindle component of the assembly, also seen in FIG. 3.
Figure 3:
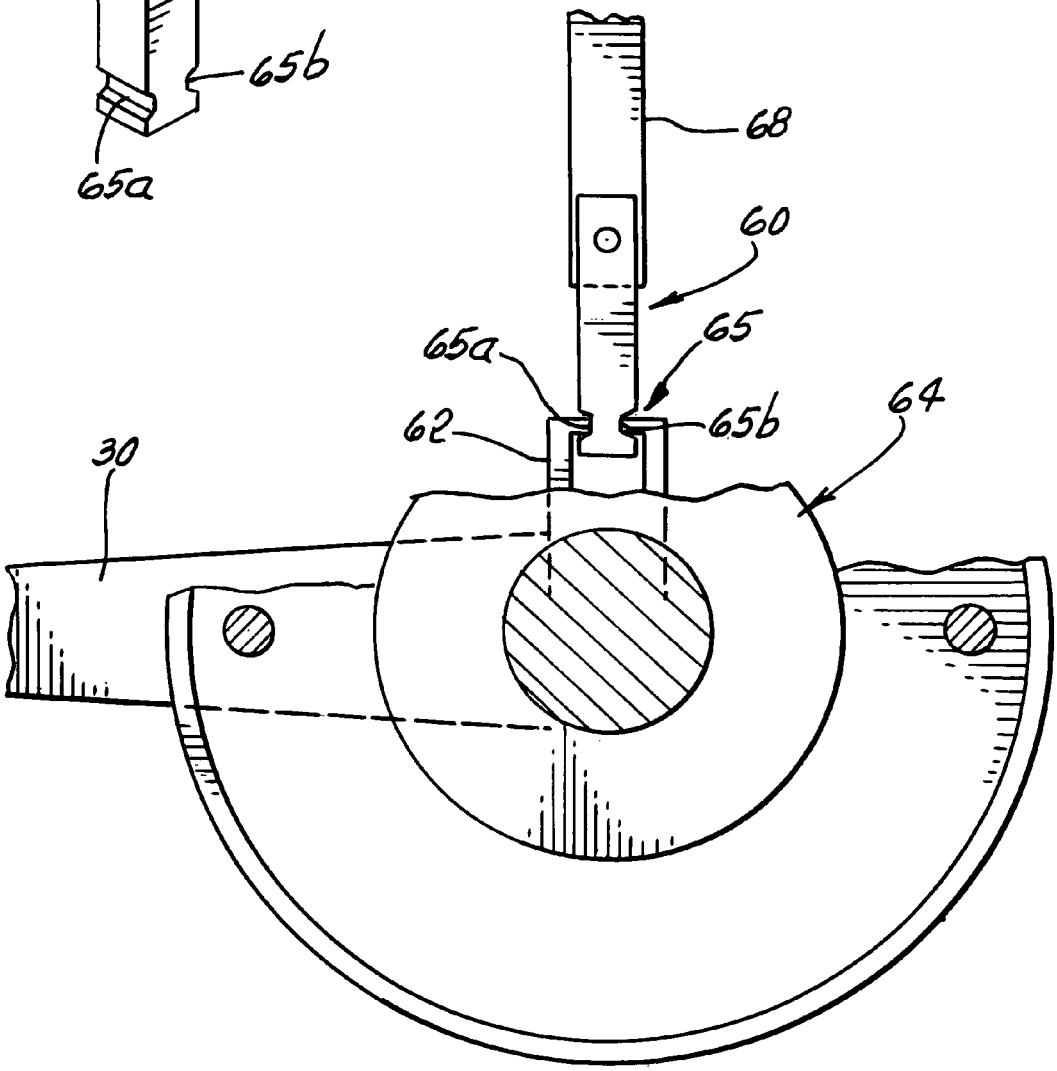
FIG. 3 is a further enlarged side view of a lower portion of the assembly.

FIGS. 2 and 3 shows provision for adjusting positioning of the rod lower end, as by a tube 68 receiving, and threaded to the rod, the tube connected to a spindle 60. The lower end of the spindle has tongue and groove connection at 65 to retainer 62, operated up and down by the mechanism 64 in turn operated by rotation of the handle 30. See FIGS. 1 and 3. The laterally linear tongue and grooves 65*a* and 65*b* prevent rotation of the spindle. The rod is threaded connection to the adaptor, whereby adaptor vertical positioning relative to the latch is easily obtained, as described.

Also shown in FIG. 5 is optional use of a compression spring 70 beneath the adaptor, and biasing the adaptor upwardly, the spring located between the adaptor and a cross-piece lower portion 71 of the U-shaped bracket 10 attached to the upper edge of the door. Spring 70 is used to counter-act weight imposed by the rod, such weight depending upon encountered differences in density of the used rod material. The spring and adaptor urge the latch upwardly, toward locked position, but allow latch retraction in response to handle actuated downward pull of the rod.

Intermediate lateral internal wall 75 of the adaptor blocks inadvertent travel of the rods end 26*a* upwardly to jam plunger 21*b*. Accordingly, compact adaptor 35 has multiple retention positioning, adjusting and aligning functions as described.

I claim:

1. Door top latch and actuating apparatus, comprising in combination, a) a mounting bracket configured to attach to a door top, b) a latch located by the mounting bracket to move up and down relative to the door top between a latching position and an unlatching position, c) an actuator rod extending vertically below the latch, and operatively connected to the latch, wherein vertical movement of the actuator rod moves the latch between the latching position and the unlatching position, d) a compression spring associated with the actuator rod for urging the actuator rod and the latch upwardly into the latching position, the compression spring accommodating downward movement of the actuator rod and the latch to allow the latch to move to the unlatching position, and e) a motion adaptor operatively connected between the actuator rod and the latch, wherein the motion adaptor includes first and second inwardly directed projections defining a gap configured for receiving the latch, and wherein the gap is configured for allowing lateral movement between the actuator rod and the latch.

2. The combination of claim 1 including a rotary assembly operatively connected to the actuator rod, wherein rotation of the rotary assembly effects downward compression of the compression spring.

3. The combination of claim 2 including a door carrying the rotary assembly, compression spring, the actuator rod, and the latch.

4. The combination of claim 3 wherein the door has a cut-out proximate the door top to receive the latch as the latch is moved between the latching position and the unlatching position.

5. The combination of claim 1 wherein the door has a cut-out proximate the door top to receive the latch as the latch is moved between the latching position and the unlatching position.

6. The combination of claim 1 wherein the compression spring is a first compression spring, wherein the combination further includes a secondary compression spring disposed between the mounting bracket and the motion adaptor, and wherein the secondary compression spring is configured for supporting the actuator rod.

7. The combination of claim 6 wherein the motion adaptor comprises i) a hollow body upwardly receiving an upper end of the actuator rod, ii) the hollow body downwardly receiving a latch plunger, wherein the latch plunger is connected to the latch, and wherein the gap is configured for receiving the latch plunger.

8. Door top latch and actuating apparatus, comprising in combination, a) a mounting bracket configured to attach to a door top and be received within a door cut-out defined in the door top, b) a latch located by the mounting bracket to move up and down relative to the door top between a latching position and an unlatching position, c) an actuator rod extending vertically below the latch, and operatively connected to the latch, wherein vertical movement of the actuator rod moves the latch between the latching position and the unlatching position, d) a first compression spring associated with the actuator rod for urging the actuator rod and the latch upwardly into the latching position, the first compression spring accommodating downward movement of the actuator rod and the latch to allow the latch to move to the unlatching position, e) a motion adaptor operatively connected between the actuator rod and the latch, and f) a secondary compression spring disposed between the mounting bracket and the motion adaptor, and wherein the secondary compression spring is configured for supporting the actuator rod, wherein the motion adaptor includes a hollow body, wherein the hollow body defines upper and lower chambers, wherein the lower chamber is configured for upwardly receiving and captivating an upper end of the actuator rod, and wherein the upper chamber is configured for downwardly receiving and captivating a lower end of a latch plunger, wherein the latch plunger is coupled to the latch, and wherein the motion adaptor accommodates to relative sidewise movement of the latch plunger and actuator rod.

9. The combination of claim 8 further including a removable side plate, wherein the lower end of the latch plunger is configured for being sidewise receivable into the upper chamber, and wherein the side plate is connectable onto the motion adaptor to further define the upper chamber.

10. The combination of claim 8 wherein the mounting bracket includes a first bracket attached to the door to define a U-shaped pocket into which the motion adaptor is received.

11. The combination of claim 10 wherein the mounting bracket further includes a second bracket carrying the latch and removably attached to the first bracket.

12. The combination of claim 1 wherein an upper end of the actuator rod is adjustably coupled to the motion adaptor.

13. The combination of claim 12 wherein the compression spring is a first compression spring, and the combination further including a second compression spring biasing the motion adaptor upwardly, the second compression spring located between the motion adaptor and a cross-piece portion of the mounting bracket attached to an upper edge of the door.

14. Door top latch and actuating apparatus, comprising in combination, a) a mounting bracket configured to attach to a door top, b) a latch located by the mounting bracket to move up and down relative to the door top between a latching position and an unlatching position, c) an actuator rod extending vertically below the latch, and operatively connected to the latch, wherein vertical movement of the actuator rod moves the latch between the latching position and the unlatching position, d) a compression spring associated with the actuator rod for urging the actuator rod and the latch upwardly into the latching position, the compression spring accommodating downward movement of the actuator rod and the latch to allow the latch to move to the unlatching position, e) a motion adaptor operatively connected between the actuator rod and the latch, f) a tube from which the actuator rod projects upwardly, the tube and the actuator rod having threaded interconnection, and g) a spindle connected to a lower end of the tube, the spindle configured for being connected to a door handle extendable structure.

15. The combination of claim 8 wherein the motion adaptor has an internal intermediate transverse wall separating the upper and lower chambers, wherein the internal intermediate transverse wall is configured for blocking engagement of actuator rod with the plunger.

16. The combination of claim 6 wherein the first and second compression springs are configured for being simultaneously compressed when the actuator rod is moved vertically to move the latch toward the unlatching position.

17. The combination of claim 1 wherein the gap is a radial gap.

* * * * *